United States Patent [19]

Collins

[11] 4,211,003

[45] Jul. 8, 1980

[54] ADAPTABLE KNIFE SHEATH

[75] Inventor: Walter W. Collins, Rock Hill, S.C.

[73] Assignee: Jenkins Metal Corporation, Gastonia, N.C.

[21] Appl. No.: 928,280

[22] Filed: Jul. 26, 1978

[51] Int. Cl.[2] ..... B26B 29/02; F41B 13/04

[52] U.S. Cl. ..... 30/162; 224/232

[58] Field of Search ..... 30/151, 162, 296 A, 30/296 R, 297, 296; 224/232, 233

[56] References Cited

U.S. PATENT DOCUMENTS

| | | | |
|---|---|---|---|
| 2,665,478 | 1/1954 | Clemens | 30/162 |
| 3,246,813 | 4/1966 | Miller | 224/232 |

FOREIGN PATENT DOCUMENTS

| | | | |
|---|---|---|---|
| 30434 | 3/1911 | Sweden | 224/2 D |

OTHER PUBLICATIONS

1977 Catalog, Atlanta Cutlery Corp., Box 33266, Decatur, Georgia, Under Arm Protection.

*Primary Examiner*—Jimmy C. Peters

*Attorney, Agent, or Firm*—Clifton T. Hunt

[57] ABSTRACT

A knife sheath including a spring pressed locking pin engagable with a hole in the handle of the knife to positively retain the knife in the sheath. The sheath also includes a buckle fastened to one side of the sheath and an adapter including a strap extending along the same side of the sheath and engagable with the buckle to provide a loop for retaining the sheath on a belt extending about a person's waist. Alternatively the strap may be removed from the buckle and the buckle connected with a shoulder harness to support the sheath and its knife upside down under a person's shoulder.

2 Claims, 9 Drawing Figures

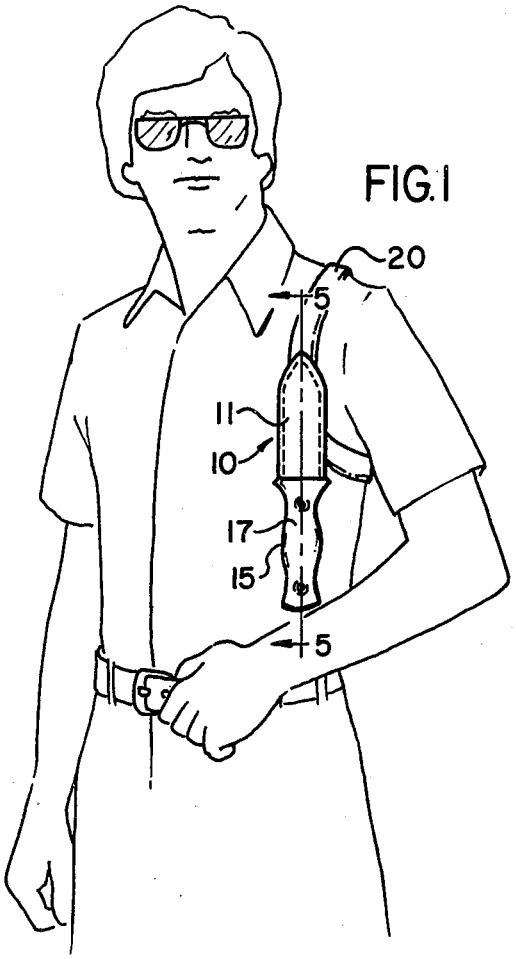
FIG. 1
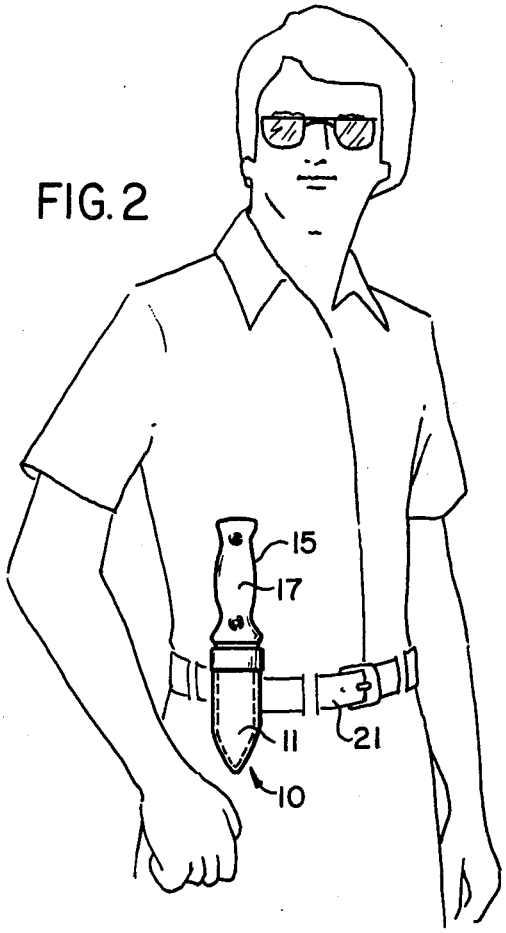
FIG. 2
FIG. 3
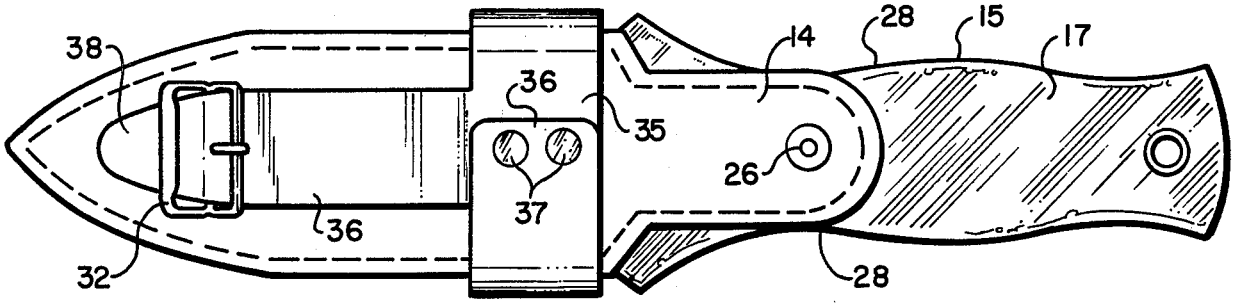
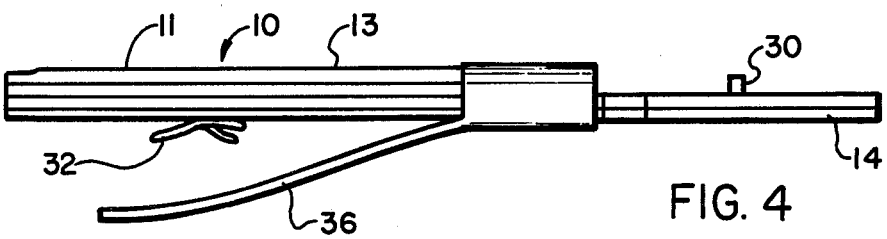
FIG. 4

ADAPTABLE KNIFE SHEATH

BACKGROUND OF THE INVENTION

This invention relates to a sheath for carrying a fixed blade knife having a handle formed integral therewith. The sheath includes means for selectively enabling the sheath and its knife to be carried upside down beneath a person's shoulder or to be carried rightside up on a belt extending about a person's waist. The sheath and knife have a slim compact configuration when assembled together to facilitate it being concealed beneath a person's coat. To applicant's knowledge there is no prior art illustrating the supporting of a knife sheath upside down from a shoulder harness.

The prior art does disclose, however, the supporting of a pistol upside down in a shoulder holster attached by snap fasteners to a shoulder harness. See U.S. Pat. No. 4,068,784 issued Jan. 17, 1978 to Robert Angell. The supporting of the knife with the handle hanging down beneath the sheath as in the present invention requires that the sheath be positively locked to the shoulder harness and that the knife be positively locked in the sheath against accidental withdrawal but in such a way as to permit quick and easy removal of the knife when desired. Applicant has found the use of snap fasteners as taught by Angell to unreliably support the sheath, whereas the buckle provides a positive attachment.

U.S. Pat. No. 2,391,574 issued Dec. 25, 1945 to Glen E. Housinger discloses a belt-supported sheath and a positive locking arrangement for holding the knife in the sheath wherein the knife handle includes a spring normally biased outwardly from the handle and including a locking pin registrable with a notch in the scabbard which supports the knife. The scabbard of Housinger is apparently formed from rigid material in order that the notch provide positive seating for the locking pin to serve its intended function of preventing accidental removal of the knife from the sheath. There is no teaching in Housinger of supporting the knife upside down from a shoulder harness and the rigidity and bulkiness of the scabbard and knife in Housinger render it unsuitable for supporting the knife upside down from a shoulder harness in accordance with this invention.

U.S. Pat. No. 2,439,197 issued Apr. 6, 1948 to Garrett J. Wykoff discloses a belt-supported sheath and mating snap fasteners on the handle of the knife and a tongue struck from the sheath for preventing the knife from being accidentally removed from the sheath. Snap fasteners do not provide the certainty of locking required to support the knife upside down from a shoulder harness as in applicant's invention.

U.S. Pat. No. 2,783,536 issued Mar. 5, 1977 and U.S. Pat. No. 2,859,516 issued Nov. 11, 1958 to Milton F. McQueary both disclose belt-supported sheaths and the use of a spring for retaining a knife within its sheath. In both instances the sheath extends about both sides of the handle and one side of the handle has a transverse rounded groove which receives a correspondingly shaped transverse rib protruding from the inner wall of the sheath. A spring is employed in each instance to normally urge the rib and the groove together. The disclosures of the McQueary patents are objectionable because the sheath extends about both sides of the knife handle providing undesirable bulk for use with a shoulder harness as in the present invention. The McQueary devices are further objectionable because the mating rounded groove and rib concept does not provide a positive locking arrangement but a frictional lock which can be accidentally overcome to cause the knife to become undesirably removed from its sheath, particularly when the knife is supported upside down with the handle beneath the sheath.

BRIEF DESCRIPTION OF THE DRAWINGS

FIG. 1 is a perspective view illustrating the knife and its sheath supported upside down on a shoulder harness;

FIG. 2 is a perspective view illustrating the use of an adapter to support the knife and its sheath rightside up on a belt extending about a person's waist;

FIG. 3 is a rear elevation of the assembled knife and sheath looking at the side opposite that shown in FIGS. 1 and 2;

FIG. 4 is a side elevation of the sheath and adapter shown in FIG. 2 with the knife removed;

DETAILED DESCRIPTION OF THE INVENTION

Figure 5:
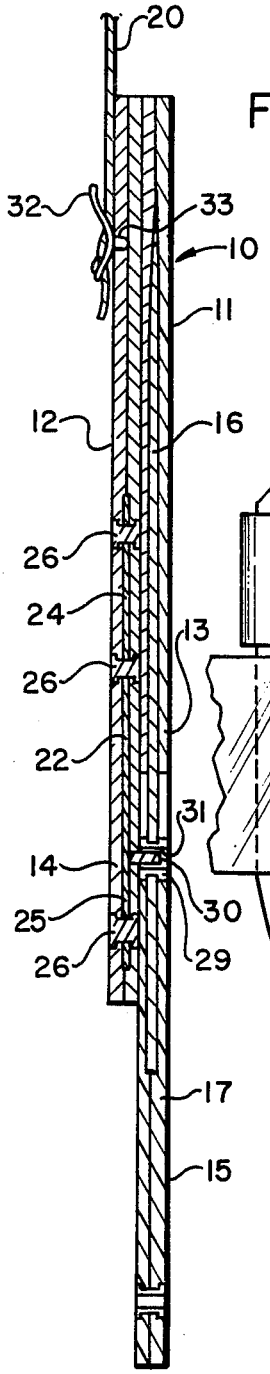
FIG. 5 is a vertical sectional view taken substantially along the line 5—5 in FIG. 1.
Figure 6:
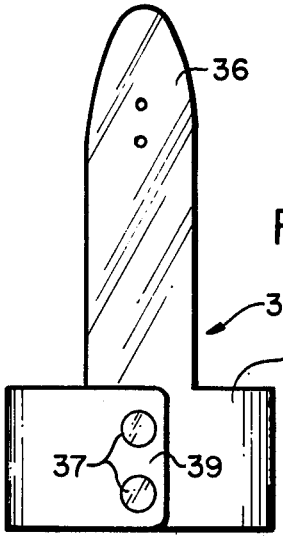
FIG. 6 is a front elevation of the adapter removed from the sheath.
Figure 7:
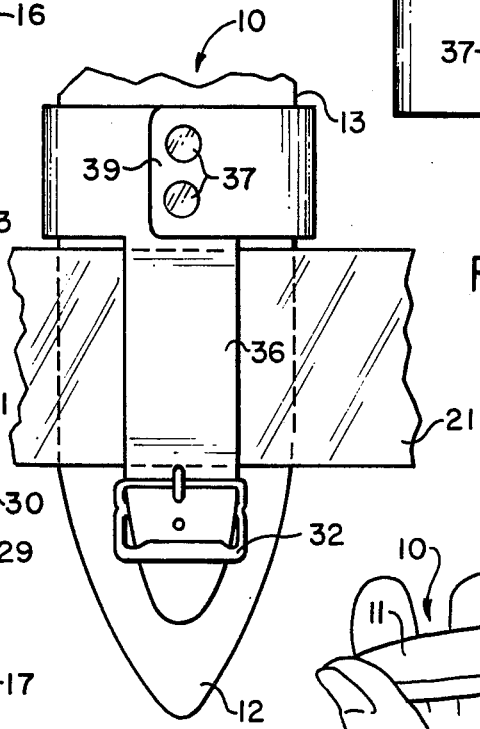
FIG. 7 is a fragmentary rear elevation of the sheath with parts broken away illustrating the use of the adapter to attach the sheath to a person's belt and looking at the opposite side of the sheath from that shown in FIG. 2.

Referring more specifically to the drawings, the numeral 10 broadly designates a knife sheath including a front wall 11 and a rear wall 12 defining a body portion 13. A retaining tab 14 is formed integral with the rear wall 12 and extends outwardly from the body portion 13.

A knife 15 having a handle 17 and blade 16 is adapted to be carried in the sheath 10. The sheath 10 and its knife 15 may be selectively carried upside down from a shoulder harness 20 (FIG. 1) or carried rightside up on a person's belt 21 (FIG. 2). It is, of course, necessary to prevent the knife 15 from becoming undesirably removed from the sheath 10 when they are carried upside down on the shoulder harness 20.

Toward this end the sheath 10 includes a leaf spring 22 having a transverse score line 23 defining a base portion 24 and an angularly extending latching portion 25. The body portion 24 of spring 22 is sandwiched between two plies of leather defining the rear wall 12 of sheath 10 and the latching portion 25 of spring 22 is embedded in the retaining tab 14 between extensions of the same plies that define the rear wall 12. Rivets 26 penetrate holes 27 in leaf spring 22 and hold the leaf spring 22 and the two plies of the rear wall 12 tightly together. A locking pin 30 is rigidly attached as by welding to the latching portion 25 of spring 22 and penetrates the inner ply of retaining tab 14 in the assembled sheath (FIG. 5).

The knife handle 17 includes a transverse opening 31 defined by a square shouldered grommet 29 extending through the inner end portion of the handle. Locking pin 30 is firmly seated in opening 31 when the knife blade 16 is fully seated in the sheath 10. The opening 31 through handle 17 is only slightly longer than the exposed portion of locking pin 30 beyond retaining tab 14, and the inwardly biased latching portion 25 forces its locking pin fully and firmly into the handle 17 through the opening 31. When the knife 15 is locked within the sheath 10 as shown in FIG. 5 removal of the knife from the sheath is not possible without overcoming spring 22 sufficiently to move the locking pin 31 completely out of opening 30, it being noted in FIG. 5 that locking pin 30 and opening 31 squarely abut each other to provide a positive lock.

Figure 8:
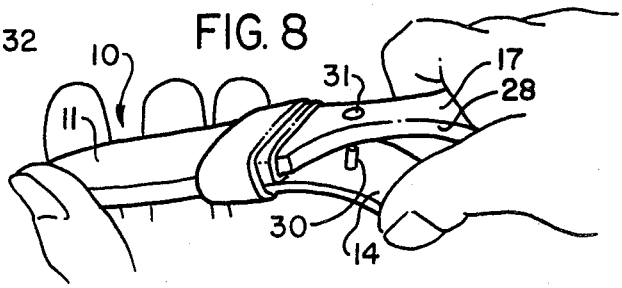
FIG. 8 is a perspective view illustrating the removal of the locking pin from the handle to permit removal of the knife from the sheath.
Figure 9:
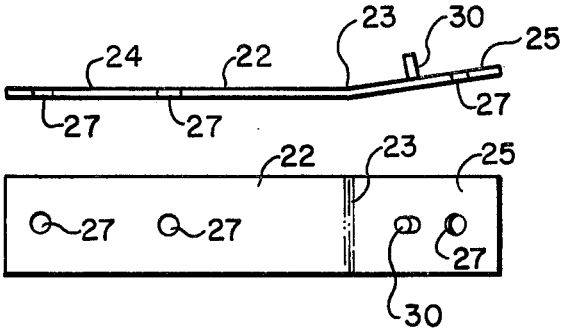
FIG. 9 is an exploded view comprising a side elevation and a top plan view of the leaf spring and its associated locking pin removed from the sheath.

Referring to FIG. 8, the retaining tab 14 with the connecting portion 25 of spring 22 may be quickly and conveniently moved away from the knife handle 17 by the thumb of the hand grasping the knife when it is desired to remove the knife from the sheath. This is facilitated by the inward curvature of the handle as indicated at 28 adjacent the free end of retaining tab 14 and by the retaining tab 14 being of a width at least equal to or slightly greater than the transverse distance between the edges of the handle at the inwardly curved area 28 adjoining the free end of tab 14.

A buckle 32 is attached to the tip end of the rear wall 12 of the sheath 10 remote from the retaining tab 14 as by stitching 33. An adapter 34 comprising an encircling band 35 and a strap 36 is removably carried by the sheath 10 for connecting the sheath to a person's belt 21 when desired. The band 35 extends circumferentially around the body portion 13 of the sheath adjacent the retaining tab 14.

As illustrated, the adapter 34 may be formed from a single sheet of leather secured upon itself by a first end 39 fastened to the medial portion of the sheet as by rivets 37 to define the band 35. A second end 38 is conveniently pointed for engagement with the buckle 32 when the strap 36 cooperates with a belt 21 to support the sheath. Alternatively the strap 36 of the adapter 34 may be removed from the buckle 32 and a strap of the shoulder harness 20 may be connected to the buckle 32 to support the sheath upside down as shown in FIGS. 1 and 5.

In summary, the sheath is positively supported by the buckle connection to the shoulder harness and the retaining tab and its spring pressed locking pin positively secure the knife within the sheath to enable it to be selectively carried with the knife depending from the sheath as shown in FIG. 1 or with the knife carried above the sheath as shown in FIG. 2.

Although specific terms have been employed in the specification they are used in a generic and descriptive sense only and not for purposes of limitation.

I claim:

1. A knife including a blade and a handle and a sheath having an open end to receive the knife blade, means for normally positively locking the knife and sheath together, means supporting the sheath and its knife upside down with the knife handle below the sheath, said means including a buckle fastened to one surface of the sheath remote from its open end, a shoulder harness including a strap engagable with said buckle to support the sheath with its open end down, and an adapter comprising a band encircling the sheath and a strap extending from the band toward the buckle for connection with the buckle, whereby a belt receiving loop is defined by the sheath, the band, the strap and the buckle.

2. A knife including a blade and a handle and a sheath having an open end to receive the knife blade, means for normally positively locking the knife and sheath together, means supporting the sheath and its knife upside down with the knife handle below the sheath, said sheath including a body portion and a retaining tab extending beyond the body portion and said first named means including a leaf spring embedded in the body portion and in the retaining tab of the sheath and biased to normally move the retaining tab inwardly, a locking pin fixed to the leaf spring and extending inwardly through said retaining tab, and a square shouldered grommet extending transversely through the handle registrable with said locking pin when the knife blade is fully seated in the body portion of the sheath.

* * * * *